US007063563B1

(12) United States Patent
Hsu

(10) Patent No.: US 7,063,563 B1
(45) Date of Patent: Jun. 20, 2006

(54) FREELY ROTATIONAL RECEPTACLE

(75) Inventor: Jung-Hui Hsu, Jhonghe (TW)

(73) Assignee: Powertech Industrial Co., Ltd., Taipei (TW)

( * ) Notice: Subject to any disclaimer, the term of this patent is extended or adjusted under 35 U.S.C. 154(b) by 0 days.

(21) Appl. No.: 11/266,292

(22) Filed: Nov. 4, 2005

(30) Foreign Application Priority Data

Jan. 7, 2005 (TW) ..... 94200339 U

(51) Int. Cl.
*H01R 13/66* (2006.01)

(52) U.S. Cl. ..... 439/527

(58) Field of Classification Search ..... 439/527, 439/538–539, 575–580, 572, 540.1, 500–502, 439/544, 546, 559, 533, 34
See application file for complete search history.

(56) References Cited

U.S. PATENT DOCUMENTS

| | | | | |
|---|---|---|---|---|
| 4,116,422 | A * | 9/1978 | Vogel et al. | 266/104 |
| 5,230,606 | A * | 7/1993 | Chin-Fu | 416/39 |
| 6,250,955 | B1 * | 6/2001 | Archuleta | 439/502 |
| 6,895,276 | B1 * | 5/2005 | Kast et al. | 607/37 |
| 6,899,559 | B1 * | 5/2005 | Kao | 439/502 |
| 2005/0195612 | A1 * | 9/2005 | Cho | 362/500 |

* cited by examiner

*Primary Examiner*—J. F. Duverne
(74) *Attorney, Agent, or Firm*—Tronell Law Office, PLLC

(57) ABSTRACT

A freely rotational receptacle includes an upper casing member with a hollow space, a receptacle body, a terminal set, a first contact ring, a second contact ring, a relay seat and a lower casing member. When the freely rotational receptacle is assembled, the receptacle body, the terminal set, the first contact ring, the second contact ring, the relay seat and the upper casing member are capable of being assembled to the lower casing member to allow the receptacle body rotating freely in a space formed by the upper and lower casing member for performing power supply.

12 Claims, 4 Drawing Sheets

FREELY ROTATIONAL RECEPTACLE

FIELD OF THE INVENTION

The present invention relates to a freely rotational receptacle, and, particularly to a receptacle structure capable of rotating 360° freely.

BACKGROUND OF THE INVENTION

The conventional rotational receptacle usually rotates 90° with fixed direction for interruption of power. Thus, when the receptacle is in use, the plug has to be turned to meet direction of the receptacle due to the direction of the receptacle being fixed. The receptacle with fixed direction is undesirable in case of the available space being very limited or the plug being rotated inconveniently.

SUMMARY OF THE INVENTION

In order to overcome the deficiency of being unable of rotating freely resided in the preceding conventional receptacle, an object of the present invention is to provide a freely rotational receptacle, which includes an upper casing member with a hollow space, a receptacle body placed in the hollow space with a plurality of locating holes at the surface thereof, a terminal set placed below the fitting holes, a first contact ring extending downward a first ring projection, a second contact ring extending downward a second ring projection, a relay seat providing a plurality of locating holes for being inserted with and holding the terminal set with the first contact ring and the second contact ring being passed through with a first locating projection and a second locating projection and forming a first recess chamber and a second recess chamber at the bottom thereof and a lower casing member being hollow for receiving the relay seat, providing a first annular groove and a second annular groove with a groove gap respectively, having a first hole and a second hole below the groove gaps respectively. Wherein, the first annular groove and the second annular groove receive the first contact ring and the second contact ring respectively and the ring projections extend outward the lower casing member via the first hole and the second hole respectively. Hence, the receptacle body, the terminal set, the first contact ring, the second contact ring, the relay seat and the upper casing member are capable of being assembled to the lower casing member to allow the receptacle body rotating freely in a space formed by the upper and lower casing member for performing power supply.

BRIEF DESCRIPTION OF THE DRAWINGS

The present invention can be more fully understood by reference to the following description and accompanying drawings, in which.

DETAILED DESCRIPTION OF THE INVENTION

Figure 1:
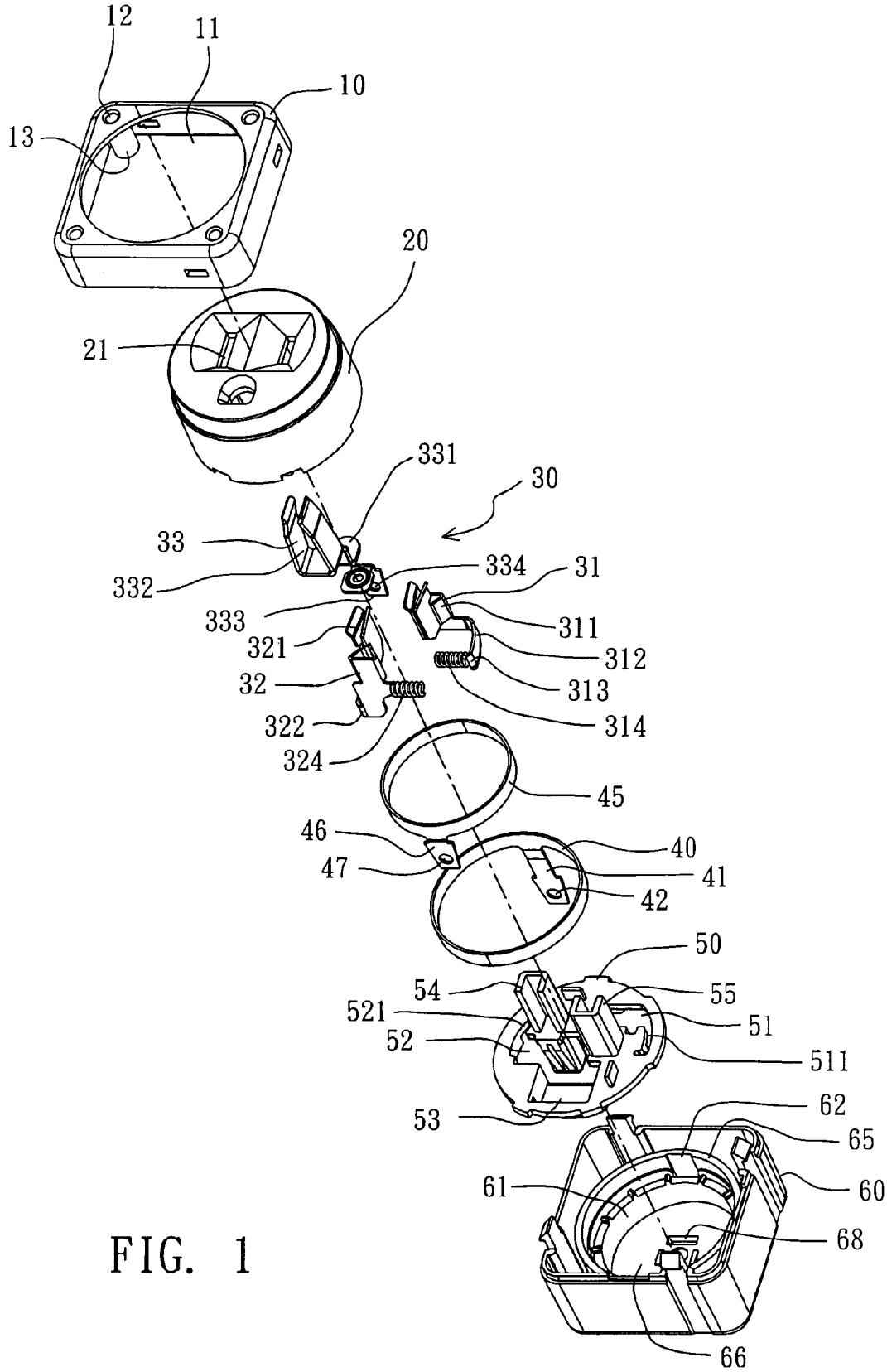
FIG. 1 is an exploded perspective view of a freely rotational receptacle according to the present invention.

Referring to FIG. 1, a freely rotational receptacle according to the present invention includes an upper casing member 10, a receptacle body 20, a terminal set 30, a first contact ring 40, a second contact ring 45, a relay seat 50 and a lower casing member 60. It is preferable that the upper casing member 10, the receptacle body 20, the relay seat 50 and the lower casing member 60 are made of insulation material such as plastics.

Wherein, the upper casing member 10 has a hollow casing part 11 with at least an engaging hole 12, an engaging post 12 and a joining hole 14 respectively for being secured to the lower casing member 60. It is noted that the engaging hole 12 is penetrated with the engaging post 13.

The receptacle body 20 is placed in the hollow casing part 11 with a plurality of locating holes 21 at the upper surface thereof for being inserted with terminals of plugs (not shown). The number of the locating holes 21 can be two or three depending on the number of terminals in the terminal set 30.

The terminal set 30 is disposed under the locating holes 21 and provides a first terminal 31, a second terminal 32 and a third terminal 33. The first terminal 31 preferably is the power terminal and includes a terminal seat 311, an arc arm 312 and a spring 314. The arc arm 312 extends outward a projection 313 from the front end thereof for being sleeved with the spring 314 and the spring 314 is received in the relay seat 50 to furnish a restoration force to the first terminal 31 after the first terminal turning back.

The second terminal 32 preferably is a neutral terminal and includes a terminal seat 321, an arc arm 322 and a spring 324. The arc arm 322 extends outward a projection 323 (not shown due to view projecting direction) from the front end thereof for being sleeved with the spring 324 and the spring 324 is received in the relay seat 50 to furnish a restoration force to the first terminal 31 after the first terminal 31 turning back.

The third terminal 33 preferably is a ground terminal and includes a base 331, a terminal seat 332 and a contact plate 333. The contact plate 333 is able to pass through an opening of the lower casing member 60 and has a wire hole 334 for connecting with a ground wire of the external power source.

The first contact ring 40 is made of metallic material such as copper and fits with the inner side of the lower casing member 60 with a ring projection 41 extending downward. The ring projection 41 further has a wire hole 42 for connecting with a power line of the external power source.

The second contact ring 45 is made of metallic material such as copper and fits with the inner side of the lower casing member 60 below the first contact ring 40. The second contact ring 45 extends downward a ring projection 46, which is preferably disposed opposite the ring projection 41, with a wire hole 47 for connecting with the neutral line of the external power source. The ring projection 41 is longer than the ring projection 46.

The relay seat 50 has a first seat hole 51, a second seat hole 52 and a third seat hole 53 for being inserted with and holding the terminal set 30, the first contact ring 40 and the second contact ring 45 respectively. Further, a first locating bar 54 and a second locating bar 55 are provided to pass through the relay seat 50 and a first recess chamber 56 and a second recess chamber 57 (shown in FIG. 2) are formed at the bottom of the relay seat 50 for receiving the springs 314 and 324 respectively. The first recess chamber 56 has a length longer than the second recess chamber 57. Besides, the first seat hole 51 further has an arc groove 511 for being penetrated by the arc arm 312 of the first terminal 31 and the second seat hole 52 further has an arc groove 521 for being penetrated by the arc arm 322 of the second terminal 32.

The lower casing member 60 is hollow for receiving the relay seat 50 and provides a first annular recess 61 and a second annular recess 65. The first annular recess 61 has a recess indentation 62 and the second annular recess 65 has a recess indentation 66. A first hole 63, a second hole 67 and a third hole 68 are provided below the recess indentation 62 and the recess indentation 66 (see FIG. 2). The first annular recess 61 and the second annular recess 65 receive the first contact ring 40 and the second contact ring 45 respectively and the ring projections 41, 46 extend outward the lower casing member 60 via the first hole 63 and the second hole 67 respectively. The first annular recess 61 is disposed below the second annular recess 65. Furthermore, inverted hooks 69 extend outward four lateral walls of the lower casing member 60 corresponding to the engaging holes 14 such that the inverted hooks 69 are capable of engaging with the engaging holes 14.

Figure 2:
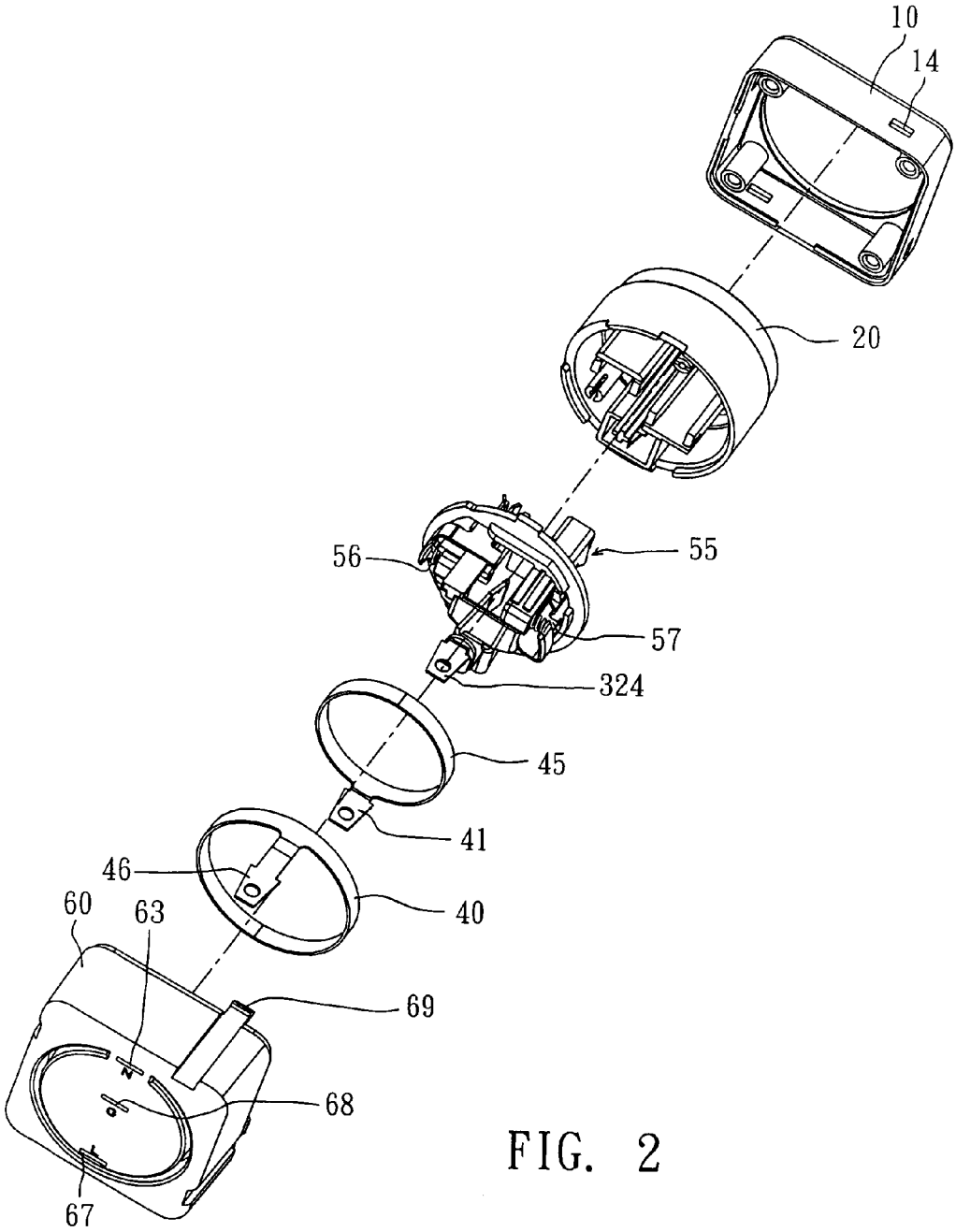
FIG. 2 is an exploded perspective view illustrating the terminal set 30 and the relay seat 40 in the freely rotational receptacle according to the present invention.

Referring to FIG. 2, assembly of the terminal set 30 and the relay seat 50 is illustrated. When the terminal set 30 is assembled to the relay seat 50, the circular arm 312 of the first terminal 31 is arranged to pass through the circular groove 511 of the first seat hole 51 to allow the spring 314 being held in the first recess chamber 56 and the terminal seat 311 being held in the first locating projection 54. Then, the circular arm 322 of the second terminal 32 is arranged to pass through the circular groove 521 of the second seat hole 52 to allow the spring 324 being held in the second recess chamber 57 and the terminal seat 321 thereof being held in the second locating projection 55. Finally, the base 331 of the third terminal 33 is held on a flat surface between the first locating projection 54 and the second locating projection 55 to allow the terminal seat 332 thereof extending upward and the contact plate 333 extending downward passing through the third seat hole 53 for completing assembly of the terminal set 30 and the relay seat 50.

Figure 3:
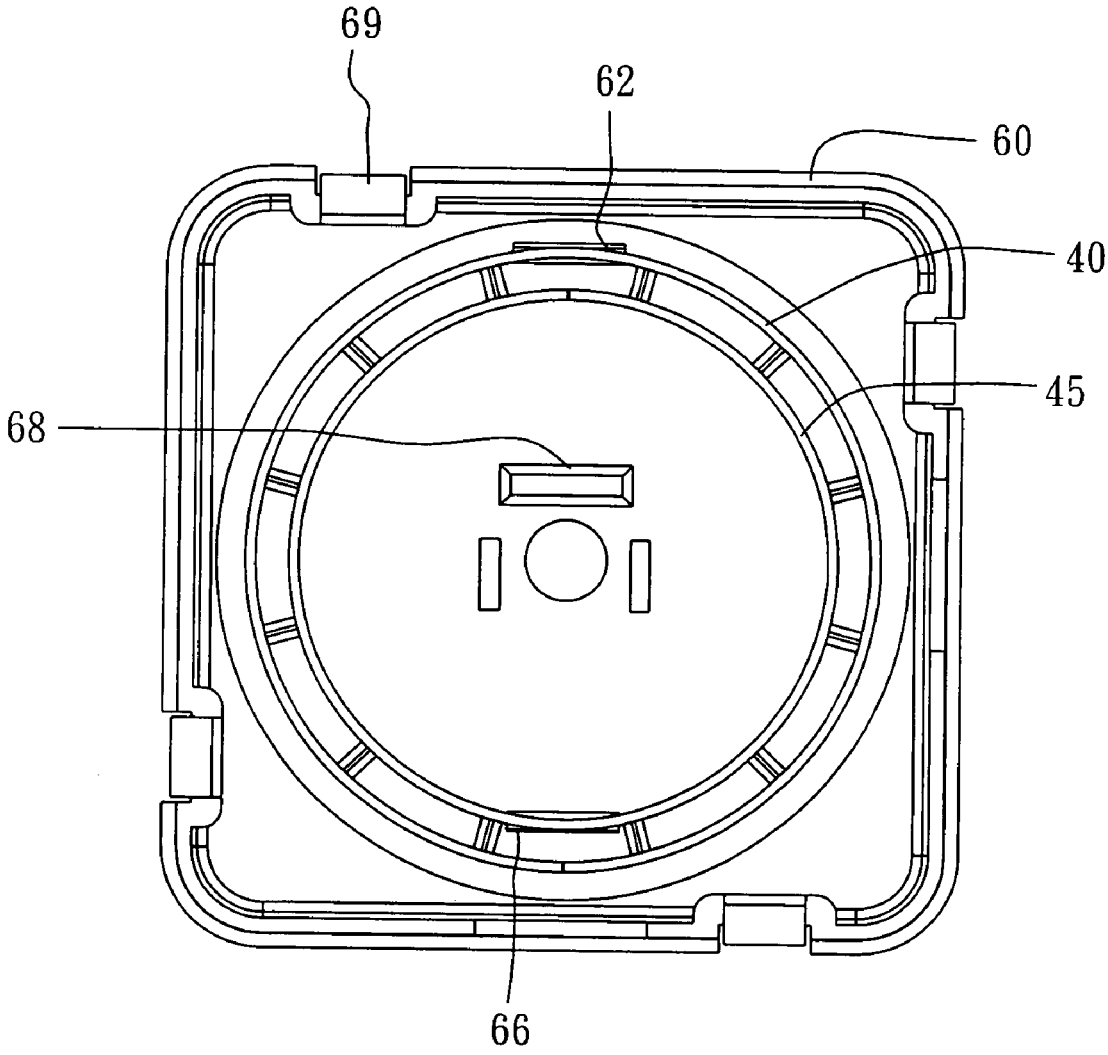
FIG. 3 is plan view illustrating the first contact ring 40, the second contact ring and the lower case member 60 in the freely rotational receptacle according to the present invention being assembled.

Referring to FIG. 3, assembly of the first contact ring 40, the second contact ring 45 and the lower casing member 60 is illustrated. The contact rings 40, 45 are placed in the lower casing member 60 via the first annular recess 61 and the second annular recess 65 respectively. Further, the ring projection 41 of the first contact ring 40 extends outward the lower casing member 60 via the indentation 62 and the first hole 63 and the second contact ring 45 extends outward the lower casing member 60 via the indentation 66 and the second hole 67. The wire hole 42 of the ring projection 41 couples the power line and the wire hole 47 of the projection 46 couples the neutral line for power supplying to the terminal set 30.

Figure 4B:
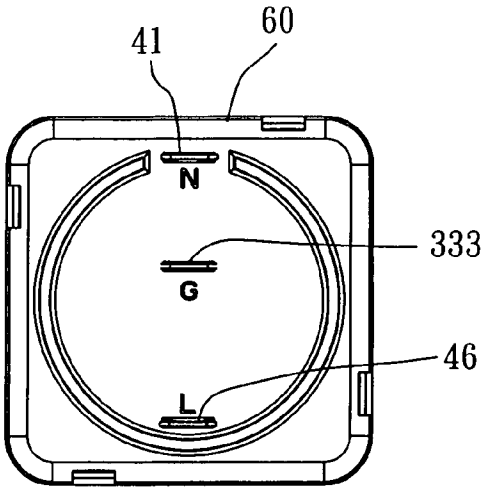
FIGS. 4 (*a*), 4 (*b*) and 4 (*c*) are top view, right side view and bottom view of the freely rotational receptacle of the present invention after being assembled.
Figure 4C:
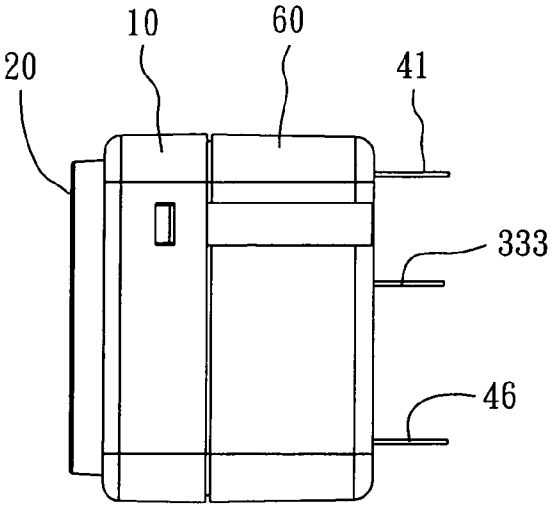
Figure 4A:
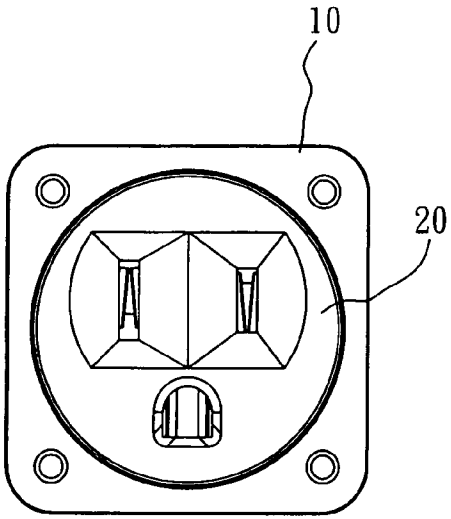

Referring to FIGS. 4(*a*), 4(*b*) and 4(*c*), the top view, right side view and bottom view of the freely rotational receptacle after being assembled are illustrated. As FIGS. 2 and 3 show, the terminal set 30 is assembled to each other and the first contact ring 40, the second contact ring 45 and the lower casing member 60 are assembled together before the terminal set 30 and the relay seat 50 can be placed in the lower casing member 60. The contact plate 333 with the wire hole 334 passes through the third hole 68 to extend outward the lower casing member 60. Meanwhile, difference of length between the first recess chamber 56 and the second recess chamber 57 allows the circular arm 312 of the first terminal 31 contacting with the first contact ring 40 and rotating in the first contact ring 40 and the circular arm 322 of the second terminal 32 contacting with the second contact ring 45 and rotating in the second contact ring 45. Next, the receptacle body 20 is arranged to cover the terminal set 30 such that the first terminal 31, the second terminal 32 and the third terminal 33 are capable of being located in the locating holes 21 respectively. Finally, the upper casing member 10 is arranged to cover the receptacle body 20 and the lower casing member 60 to align the inverted hooks 69 to the engaging holes 14 for the inverted hooks 69 engaging with the engaging holes 14. Hence, the preceding structure allows the receptacle body 20, the terminal set 30 and the relay seat 50 to rotate 360° freely in the lower casing member 60 in addition to power supply.

It is appreciated that a freely rotational receptacle according to the present invention is capable of allowing the receptacle body 20, the terminal set 30 and the relay seat 50 to rotate 360° freely in the lower casing member 60 in addition to power supply and the deficiency of the prior art can be overcome completely.

While the invention has been described with reference to the preferred embodiments thereof, it is to be understood that modifications or variations may be easily made without departing from the spirit of this invention, which is defined by the appended claims.

What is claimed is:

1. A freely rotational receptacle, comprising:

an upper casing member, having a hollow space;

a receptacle body, being placed in the hollow space with a plurality of locating holes at the surface thereof;

a terminal set, being placed below the fitting holes;

a first contact ring, extending downward a first ring projection;

a second contact ring, extending downward a second ring projection;

a relay seat, providing a plurality of locating holes to be inserted with and hold the terminal set, the first contact ring and the second contact ring, being passed through with a first locating projection and a second locating projection and forming a first recess chamber and a second recess chamber at the bottom thereof; and a lower casing member, being hollow to receive the relay seat, providing a first annular groove and a second annular groove with a groove gap respectively, having a first hole and a second hole below the groove gaps respectively;

wherein, the first annular groove and the second annular groove receive the first contact ring and the second contact ring respectively and the ring projections extend outward the lower casing member via the first hole and the second hole respectively;

whereby, the receptacle body, the terminal set, the first contact ring, the second contact ring, the relay seat and the upper casing member are assembled to the lower casing member to allow the receptacle body rotating freely in a space formed by the upper and lower casing member to perform power supply.

2. The freely rotational receptacle as defined in claim 1, wherein the upper casing member further provides at least an engaging hole, an engaging post and a joining hole at the circumference thereof respectively for being secured to the lower casing member.

3. The freely rotational receptacle as defined in claim 1, wherein the receptacle body preferably has three locating holes.

4. The freely rotational receptacle as defined in claim 1, wherein the terminal set further comprises a first terminal, a second terminal and a third terminal.

5. The freely rotational receptacle as defined in claim 4, wherein the first terminal preferably is a power line terminal and further comprises a terminal seat, a circular arm and a spring with the circular arm extending an arm projection for being sleeved with the spring and the spring being received in the first recess chamber for offering a restoration force to the second terminal after the second terminal rotating.

6. The freely rotational receptacle as defined in claim 4, wherein the second terminal preferably is a neutral line terminal and further comprises a terminal seat, a circular arm and a spring with the circular arm extending an arm projection from the front end thereof for being sleeved with the spring and the spring being received in the second recess chamber for offering a restoration force to the third terminal after the third terminal rotating.

7. The freely rotational receptacle as defined in claim 4, wherein the third terminal preferably is a ground terminal and further comprises a base, a terminal seat and a contact plate with the terminal seat receiving a ground terminal of a plug and the contact plate with a wire hole passing through the second hole for connecting a ground line of an external power source.

8. The freely rotational receptacle as defined in claim 1, wherein the first ring projection and the second ring projection further have a wire hole respectively.

9. The freely rotational receptacle as defined in claim 1, wherein the seat holes further comprise a first seat hole, a second seat hole and a third seat hole and the first seat hole and the second seat hole have a circular groove respectively.

10. The freely rotational receptacle as defined in claim 1, wherein the recess chamber is longer than the second recess chamber.

11. The freely rotational receptacle as defined in claim 1, wherein the lower casing member provides a third hole at the bottom thereof.

12. The freely rotational receptacle as defined in claim 2, wherein the lower casing member provides an inverted hook at lateral walls thereof respectively corresponding to the engaging hole of the upper casing member in number and location for engaging with the engaging hole.

* * * * *